United States Patent [19]

Bentley

[11] 4,349,321

[45] Sep. 14, 1982

[54] LIQUID DISPENSING SYSTEMS

[76] Inventor: Peter N. Bentley, "Sandown", Stoke-on-Trent, England

[21] Appl. No.: 93,875

[22] Filed: Nov. 13, 1979

Related U.S. Application Data

[63] Continuation-in-part of Ser. No. 904,563, May 10, 1978, abandoned.

[30] Foreign Application Priority Data

Jul. 22, 1977 [GB] United Kingdom ..... 30813/77

[51] Int. Cl.[3] ..... F04B 25/00; F04B 23/06

[52] U.S. Cl. ..... 417/250; 417/265; 417/429; 417/503; 417/263; 137/533.11

[58] Field of Search ..... 417/429, 259, 263, 264, 417/265, 503, 524, 250; 137/533.11

[56] References Cited

U.S. PATENT DOCUMENTS

| | | | |
|---|---|---|---|
| 255,928 | 4/1882 | Brunton | 417/250 |
| 720,100 | 2/1903 | Bashlin | 137/533.11 X |
| 1,021,861 | 4/1912 | Caverno | 417/265 |
| 3,033,123 | 5/1962 | Kinzelman | 417/264 |
| 3,055,391 | 9/1962 | Shuk et al. | 137/533.11 X |

FOREIGN PATENT DOCUMENTS

| | | | |
|---|---|---|---|
| 330237 | 12/1920 | Fed. Rep. of Germany | 137/533.11 |
| 530108 | 12/1976 | U.S.S.R. | 417/503 |

*Primary Examiner*—Richard E. Gluck
*Attorney, Agent, or Firm*—C. O. Marshall, Jr.

[57] ABSTRACT

A valve chamber connected to the inlet of a ram pump has an inlet connected to a source of sludge and a substantially smaller inlet connected to the outlet of a metering pump.

A valve seat in the valve chamber has a ball resting freely thereon, and an operative connection between the ram pump and the metering pump synchronizes the suction stroke of the ram pump with the discharge stroke of the metering pump to cause the incoming sludge to lift and spin the ball and thereby mix the sludge with the incoming additive.

4 Claims, 3 Drawing Figures

14

SOURCE OF SLUDGE
12
10
28
30
32
26
24
FILTER PRESS
16
18
15
20
22

LIQUID DISPENSING SYSTEMS

The present application is a continuation-in-part of Ser. No. 904,563 filed May 10, 1978, now abandoned.

This invention relates to a liquid dispensing system in which a first or additive liquid is supplied to and mixed with a second or main liquid.

The invention is particularly concerned with the treatment of sludges, slurries and like mixtures of solids and liquids herein collectively called 'sludges', which are to be filtered in a filter press, for example so as to concentrate the solid material, and/or as a first stage in the purification of the water.

In the treatment of mine tailings, that is (for example) the water which has been used to wash coal, and which contains clay, shale particles and the like it is common practice to add a flocculent before passing the tailings liquid to a filter press. Another example is in the dewatering of sewage sludge, where it is commonplace to add lime and coppras (ferric sulphate) to the sewage, and in all of these cases the effect is to increase the speed of operation of the filter press.

Other materials which are known as additives for like purposes, particularly for sewage, include aluminium chlorohydrate and polyelectrolytes. These materials are however relatively expensive (in terms of the running costs of the sewage plant) and for that and other reasons require to be metered to the sludge in precise controlled amounts. Further, they require to be thoroughly mixed with the sludge, and at least in the case of the polyelectrolytes difficulties have been found in practice because of their nature. In particular, they are relatively fragile long chain molecules, which tend to rupture when exposed to sunlight or frost, so that desirably they are added immediately before the actual filter press operation, and moreover must not be subject to any shearing action, such as is involved in conventional rotary paddle sewage conditioning ponds.

The objects of the present invention are to provide improved apparatus for metering additives to and admixing with sludges.

In accordance with the present invention, sludge pumping and additive metering and admixing apparatus, comprises a main ram pump provided with an inlet for connection to a sludge supply and with an outlet for connection to a filter press, the inlet and outlet being controlled respectively by ball valves, and said ram being connected to the piston of a metering pump, which has an inlet for connection to an additive liquid supply, and an outlet connected to an inlet of the sludge pump, the inlet and outlet of the metering pump being controlled by respective ball valves, and the piston of the metering pump forming a flow passage for the additive, being provided with a further ball valve in said piston, so that on an induction stroke of the sludge pump and the metering pump, additive liquid is drawn into the metering pump on the inlet side of the piston, and additive liquid in the metering pump cylinder on the opposite side of said piston is discharged into the sludge pump inlet, and on a return stroke, additive liquid in the metering pump on the inlet side of the piston is transferred to the opposite side of said piston but without further discharge on the sludge pump.

The use of ball valves to control the flows is particularly important, in that these may operate to seat and close at the end of an appropriate stroke without effecting any substantial shearing action which might damage the additive if it is a polyelectrolyte. Further, at least in the case of the ball valve controlling the inlet to the sludge pump, the ball therein will spin when lifted off its seat during the induction stroke and assist in creating substantial turbulence in the ball chamber, thereby ensuring thorough mixing of the sludge with the additive during passage through that chamber.

In order to provide for the metered dose of additive, the stroke of the metering pump relative to the stroke of the sludge pump may be variable and adjustable. One convenient way of doing this, is to provide a lateral extension from a crosshead of the sludge pump ram and extending the piston rod of the metering pump through an aperture in that extension, with adjustable abutments securable to the piston rod from either side of the crosshead, so as to provide for a degree of lost motion of the crosshead before the piston rod is displaced.

The invention is now more particularly described with reference to the accompanying drawings wherein.

Figure 1:
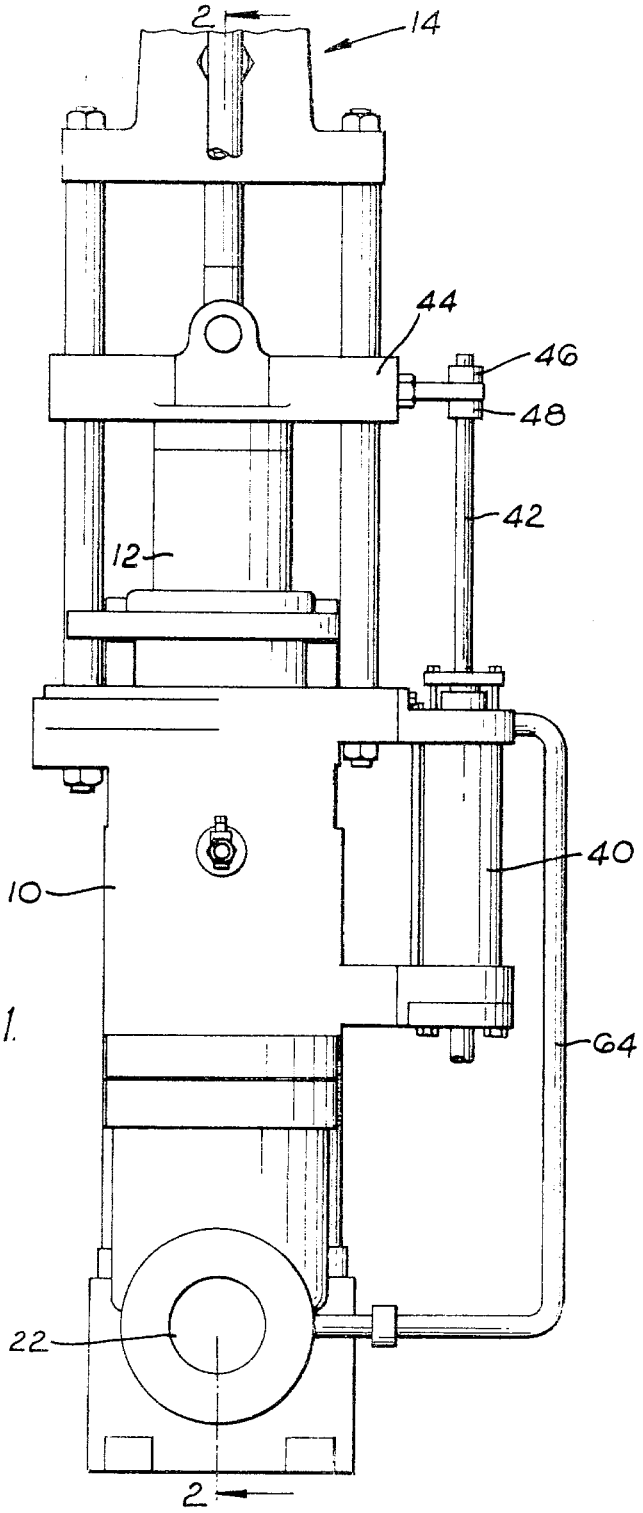
FIG. 1 is an elevation of a typical embodiment of the invention.
Figure 2:
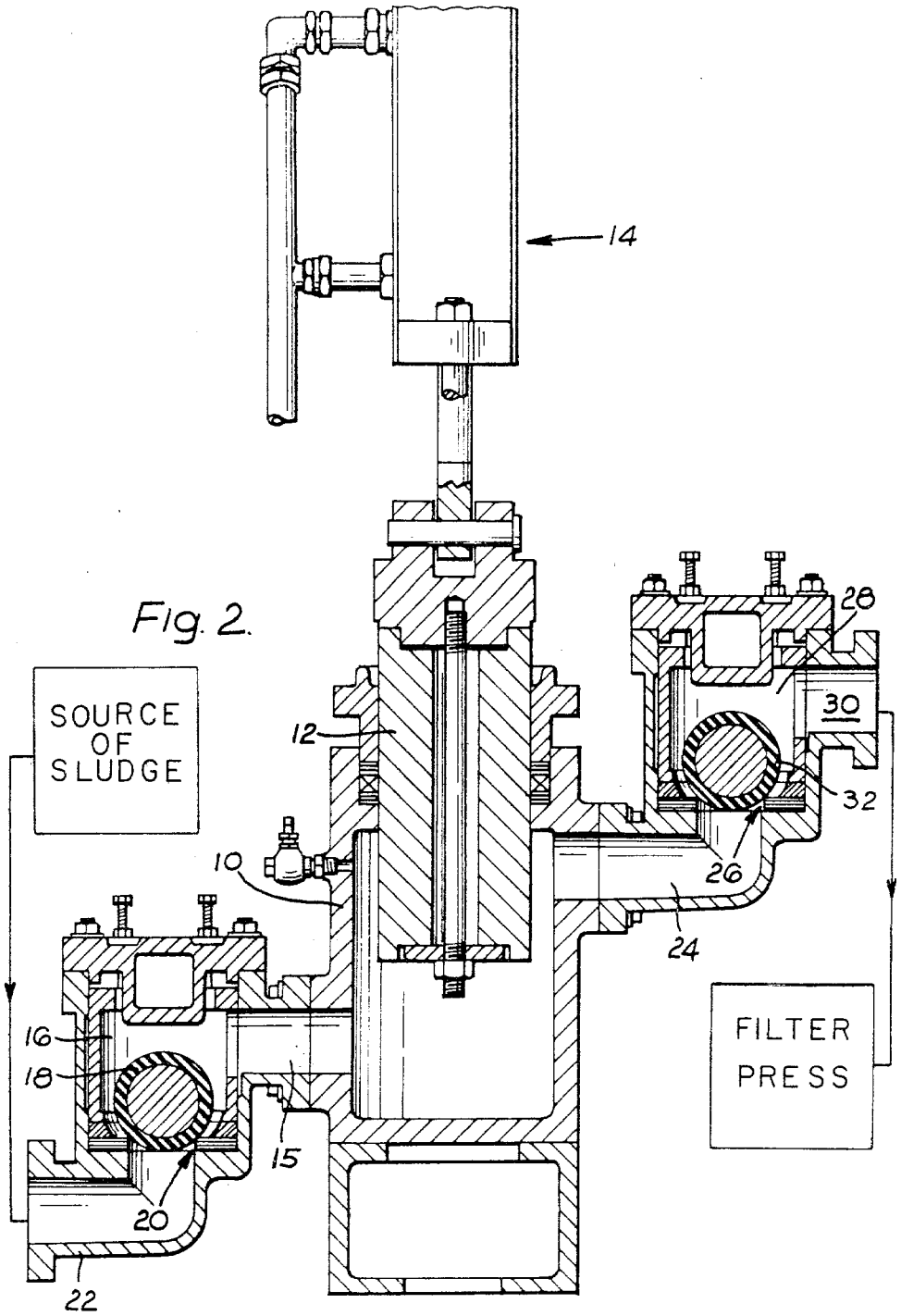
FIG. 2 is a sectional elevation taken on the line 2—2 of FIG. 1.

Turning now to the drawings, the apparatus comprises a main pump cylinder 10 which receives main ram 12 and the latter is connected to or forms part of the piston or ram assembly of a hydraulic cylinder generally indicated by the reference numeral 14 which serves to reciprocate ram 12 in the vertical direction in the main cylinder 10.

The main cylinder is connected via an inlet 15 to inlet chamber 16 housing a loose ball 18 disposed above a seat 20 at the end of pipe 22 which is for connection to the sludge supply. The upper end of the cylinder 10 is connected to an outlet 24 provided with seat 26 opening to a ball chamber 28 which has a sludge outlet 30 for connection to a filterpress. The chamber 28 houses a further loose ball 32.

In operation, an upward stroke of the ram reduces the pressure within the main cylinder 10, draws outlet ball 32 onto its seat, and lifts inlet ball 18 off its seat, so that a flow of sludge is induced through the inlets 22 15 into the cylinder 10. On the return stroke of the ram, the ball 18 seats and the ball 32 is lifted off its seat, and the sludge is expressed through the outlets 24 30.

Operation of the cylinder 14 is controlled via a four-way valve (not shown) which reverses the oil supply connections to the hydraulic cylinder 14 from the supply pump therefor each time the main ram 12 reaches predetermined upper and lower limits of its travel. In practice, the time taken for the ram 12 to execute its return or suction stroke (i.e. to move from its lower limit to its upper limit) will be constant whereas the time taken to execute the delivery stroke (i.e. from upper to lower limit) will depend upon the pressure within the filter press. Thus, as the filter press fills up, the period of the delivery stroke will gradually become longer and longer.

Mounted generally parallel to the cylinder 10 is an additive cyliner 40 provided with piston rod 42 which is connected to a crosshead 44 on the main ram so as to be reciprocable with the main ram. The piston rod 42 passes loosely thrugh an aperture in an extension of the crosshead, and is provided with a pair of collars 46 48 which can be clamped to the piston rod so as to form spaced abutments, and so that movement of the piston rod 42 in the downward direction will commence when the crosshead extension contacts abutment 48, and in the reverse direction, there may be lost motion before the crosshead contacts abutment 46. In the illustrated version, the abutments are closely spaced and no lost motion will be provided. The effect of lost motion will be to vary the stroke of piston rod 42 so that it is shorter than that of the main ram 12, and hence inject less additive.

Figure 3:
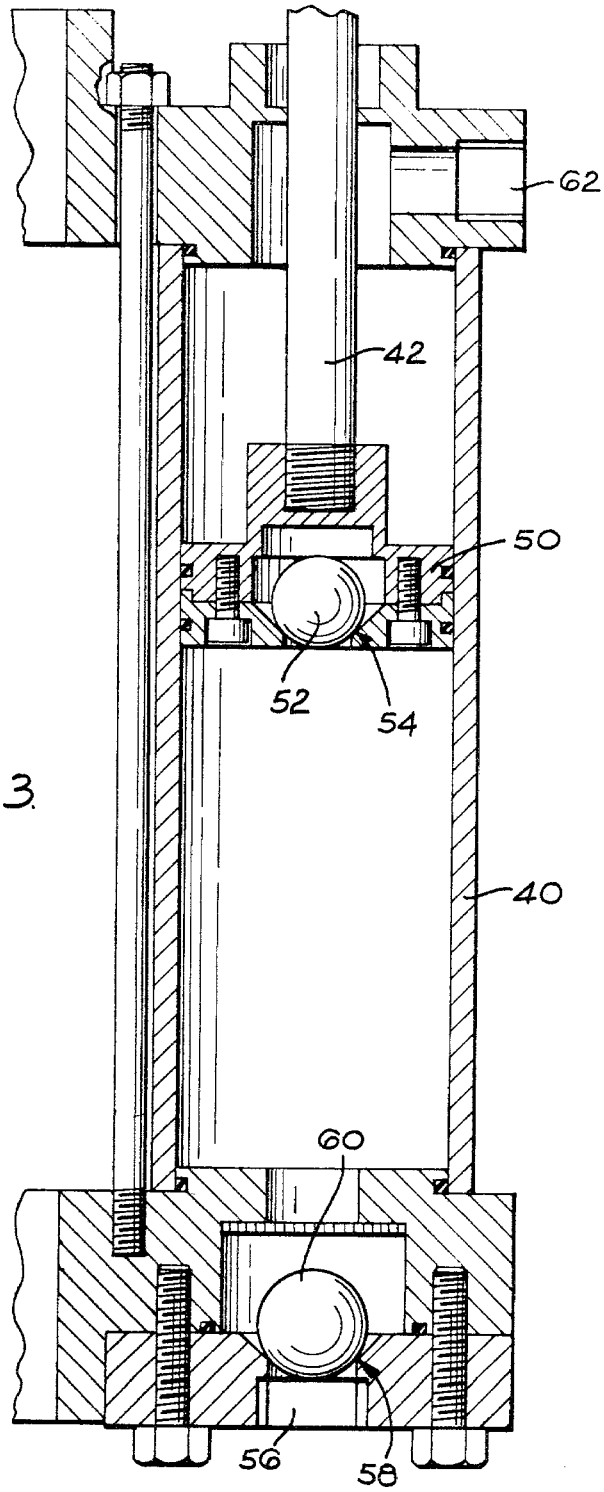
FIG. 3 is an enlarged and fragmentary sectional elevation of the metering pump cylinder, forming part of the apparatus shown in FIG. 1.

As best seen in FIG. 3, the metering cylinder houses a piston 50 which also houses a loose ball 52 associated with a seat 54. The lower end of metering cylinder 40 is connected to an additive supply line via inlet 56 which opens via seat 58 for a loose ball 60, and the upper end of the cylinder 40 is connected via outlet 62 and pipe 64 (see FIG. 1) to the inlet chamber 16 of the main cylinder.

On the upward stroke of piston 50 additive is drawn through the inlet 56 and through the chamber housing the ball 60 into the cylinder below the piston 50. At the same time, additive in the cylinder 40 above the piston 50 is displaced through the outlet 62 and into the ball chamber 16. On this upward stroke, the main ram 12 is also performing an upward or induction stroke, and hence the additive is injected into the chamber 16 at the time when sludge is flowing through that chamber so as to be intimately mixed with the sludge. In practice the ball 18 spins and assists in the creation of turbulence in the chamber 16 thus assisting in complete and thorough mixture of additive with sludge.

It will be observed that immediately prior to encountering the balls 18, 32, the sludge flow undergoes a change in flow direction in the pipe portions 22, 24 so that the sludge impinges obliquely against the balls thereby enhancing the tendency of the balls to spin which aids mixing. Mixing is further aided by the fact that the sludge/additive mixture has to flow up the sides of the ram 12 in order to reach the outlet 24 so that a part recirculatory flow is created within the pump chamber. These factors contribute to thorough mixing of the sludge and additive and make it possible to effect mixing while the sludge is actually being transferred from the source of sludge to the filter press thereby eliminating the capital costs involved in having to provide special mixing equipment at the source.

On the downward stroke of the piston 50, ball 60 seats to prevent flow out of the cylinder through the inlet 56, and ball 52 opens to permit displacement of the additive in the cylinder 40 below the piston through the piston into the space above the piston. It will be noted that even though the period of the delivery stroke of the main pump 12 is variable, a controlled and uniform supply of additive to the sludge flow is possible because the additive pump is driven in unison with the main pump.

Additional non-return valves, for example ball valves, or control valves and drain taps may be provided in the line 64 for convenience of operation.

All of the ball valves shown in the drawings are shown as loose balls, but if desired, and particularly in the case of the balls in the additive flow line, springs may be used to assist in seating of the balls which will allow them to lift and open at appropriate times.

Having now described my invention what I claim is:

1. Apparatus for feeding to a filter press sludge intimately admixed with an accurately metered proportion of an additive, comprising a source of sludge, a filter press, a ram pump having an outlet connected through a check valve to the filter press and having an inlet, and a reciprocating metering pump for supplying an additive, having an outlet, wherein the improvement comprises apparatus for intimately admixing sludge with an accurately metered proportion of an additive, comprising a valve chamber which is connected between the inlet of the ram pump and a pipe connected to the source of sludge, said valve chamber having a substantially smaller inlet connected to the outlet of the metering pump, a valve seat in the valve chamber having a ball resting freely thereon, and an operative connection between the ram pump and the metering pump which synchronizes the suction stroke of the ram pump with the discharge stroke of the metering pump to cause the incoming sludge to lift and spin the ball and thereby mix the sludge with the incoming additive.

2. In an apparatus for feeding to a filter press sludge intimately admixed with an accurately metered proportion of an additive, comprising a ram pump having an outlet connected through a check valve to a filter press and having an inlet, and a reciprocating metering piston pump for supplying an additive, having an outlet, the improvement which comprises apparatus for intimately admixing sludge with an accurately metered proportion of an additive, comprising a valve chamber which is connected between the inlet of the ram pump and a pipe connected to a source of sludge, said valve chamber having a substantially smaller inlet connected to the outlet of the metering pump, a valve seat in the valve chamber having a ball resting freely thereon, and an operative connection between the ram pump and the metering pump which synchronizes the suction stroke of the ram pump with the discharge stroke of the metering pump to cause the incoming sludge to lift and spin the ball and thereby mix the sludge with the incoming additive.

3. In an apparatus as claimed in claim 2, an angled duct immediately preceding the valve seat in said valve chamber, whereby the sludge flow impinges obliquely on the ball to enhance the tendency of the ball to spin.

4. In an apparatus as claimed in claim 2, a cross head connected to a ram of the ram pump, the metering piston pump having a piston rod carrying adjustable abutments arranged for contacting opposite sides of the cross head to drive the metering pump through an adjustable stroke.

* * * * *